US010450662B2

(12) United States Patent
Kumar et al.

(10) Patent No.: US 10,450,662 B2
(45) Date of Patent: Oct. 22, 2019

(54) DEVICE AND METHOD FOR CONVERSION OF CARBON DIOXIDE TO ORGANIC COMPOUNDS

(71) Applicant: Indian Oil Corporation Limited, Mumbai (IN)

(72) Inventors: Manoj Kumar, Faridabad (IN); Mahendra Pratap Singh, Faridabad (IN); Umish Srivastava, Faridabad (IN); Anurag Ateet Gupta, Faridabad (IN); Biswapriya Das, Faridabad (IN)

(73) Assignee: Indian Oil Corporation Limited, Mumbai (IN)

( * ) Notice: Subject to any disclaimer, the term of this patent is extended or adjusted under 35 U.S.C. 154(b) by 243 days.

(21) Appl. No.: 15/242,439

(22) Filed: Aug. 19, 2016

(65) Prior Publication Data

US 2017/0058409 A1 Mar. 2, 2017

(30) Foreign Application Priority Data

Aug. 25, 2015 (IN) ..... 3254/MUM/2015

(51) Int. Cl.

| | |
|---|---|
| ***C25B 3/04*** | (2006.01) |
| ***C25B 9/10*** | (2006.01) |
| ***C25B 15/08*** | (2006.01) |
| ***C25B 11/04*** | (2006.01) |

(52) U.S. Cl.

CPC ..... *C25B 3/04* (2013.01); *C25B 9/10* (2013.01); *C25B 11/0442* (2013.01); *C25B 15/08* (2013.01)

(58) Field of Classification Search

CPC .. C25B 3/04; C25B 9/10; C25B 15/08; C25B 11/0442

See application file for complete search history.

(56) References Cited

U.S. PATENT DOCUMENTS

| | | | |
|---|---|---|---|
| 8,696,883 | B2 | 4/2014 | Yotsuhashi et al. |
| 2011/0315560 | A1 | 12/2011 | Rabaey et al. |
| 2012/0288898 | A1 | 11/2012 | Lovley et al. |

FOREIGN PATENT DOCUMENTS

| | | | |
|---|---|---|---|
| EP | 2373832 | A1 | 10/2011 |
| WO | 2013030376 | A1 | 3/2013 |

*Primary Examiner* — Gautam Prakash

(74) *Attorney, Agent, or Firm* — Snell & Wilmer L.L.P.

(57) ABSTRACT

The present invention relates to a device for bioassisted conversion of carbon dioxide to organic compounds that can be used a fuels and chemicals. The present invention also relates to a bioassisted process of converting carbon dioxide to organic compounds.

16 Claims, 4 Drawing Sheets

DEVICE AND METHOD FOR CONVERSION OF CARBON DIOXIDE TO ORGANIC COMPOUNDS

CROSS-REFERENCE TO RELATED APPLICATIONS

This patent application claims priority pursuant to 35 U.S.C. § 119(b) and 37 CFR 1.55(d) to Indian Patent Application No. 3254/MUM/2015, filed Aug. 25, 2015, which application is incorporated herein in its entirety by reference.

FIELD OF THE INVENTION

The present invention relates to a device for bioassisted conversion of carbon dioxide to organic compounds that can be used a fuels and chemicals. The present invention also relates to a bioassisted process of converting carbon dioxide to organic compounds.

BACKGROUND OF THE INVENTION

The rising concentration of green house gases (GHGs), particularly $CO_2$ has led to several undesirable consequences such as global warming and related changes. One of its desired and sustainable mitigation options is to use $CO_2$ as feedstock and convert into value added products.

US patent application US2013/0118907A1 discloses a method for reducing $CO_2$ utilizes a $CO_2$ reduction device comprises of a cathode and anode electrode. The cathode electrode is made up of indium or indium compounds while anode is a photoelectrode. The anode is irradiated with light source which results in release of electrons. These electrons at cathode reduce the $CO_2$ to formic acid, carbon monoxide and hydrogen. However, in the process carbon monoxide is also produced which is highly toxic gas.

Patent "Process for production of chemicals" EP 2373832 A1 describes a process for producing one or more chemical compounds comprising the steps of providing a bioelectrochemical system having an anode and a cathode separated by a membrane, the anode and the cathode being electrically connected to each other, causing oxidation to occur at the anode and causing reduction to occur at the cathode to thereby produce reducing equivalents at the cathode, providing the reducing equivalents to a culture of microorganisms, and providing carbon dioxide to the culture of microorganisms, whereby the microorganisms produce the one or more chemical compounds, and recovering the one or chemical compounds.

US 20120288898 A1 discloses a microbial production of multi-carbon chemicals and fuels from water and carbon dioxide using electric current provides systems and methods for generating organic compounds using carbon dioxide as a source of carbon and electrical current as an energy source. In one embodiment, a reaction cell is provided having a cathode electrode and an anode electrode that are connected to a source of electrical power, and which are separated by a permeable membrane. A biological film is provided on the cathode. The biological film comprises a bacterium that can accept electrons and that can convert carbon dioxide to a carbon-bearing compound and water in a cathode half-reaction. At the anode, water is decomposed to free molecular oxygen and solvated protons in an anode half-reaction. The half-reactions are driven by the application of electrical current from an external source. Compounds that have been produced include acetate, butanol, 2-oxobutyrate, proponal, ethanol, and formate.

US20110315560 relates to a process for producing one or more chemical compounds comprising the steps of providing a bioelectrochemical system having an anode and a cathode separated by a membrane, the anode and the cathode being electrically connected to each other, causing oxidation to occur at the anode and causing reduction to occur at the cathode to thereby produce reducing equivalents at the cathode, providing the reducing equivalents to a culture of microorganisms, and providing carbon dioxide to the culture of microorganisms, whereby the microorganisms produce the one or more chemical compounds, and recovering the one or chemical compounds.

U.S. Pat. No. 8,696,883 provides a method for reducing carbon dioxide with the use of a device for reducing carbon dioxide. The device includes a cathode chamber, an anode chamber and a solid electrolyte membrane. The cathode chamber includes a working electrode Which includes a metal or a metal compound. The anode chamber includes a counter electrode which includes a region formed of a nitride semiconductor. First and second electrolytic solutions are held in the cathode and anode chamber, respectively. The working electrode and the counter electrode are in contact with the first and second electrolytic solution, respectively. The solid electrolyte membrane is interposed between the cathode and anode chambers. The first electrolyte solution contains the carbon dioxide. An electric source is not interposed electrically between the working electrode and the counter electrode.

US20120288898 provides systems and methods for generating organic compounds using carbon dioxide as a source of carbon and electrical current as an energy source. In one embodiment, a reaction cell is provided having a cathode electrode and an anode electrode that are connected to a source of electrical power, and which are separated by a permeable membrane. A biological film is provided on the cathode. The biological film comprises a bacterium that can accept electrons and that can convert carbon dioxide to a carbon-bearing compound and water in a cathode half-reaction. At the anode, water is decomposed to free molecular oxygen and solvated protons in an anode half-reaction. The half-reactions are driven by the application of electrical current from an external source. Compounds that have been produced include acetate, butanol, 2-oxobutyrate, propanol, ethanol, and formate.

WO2013030376 relates to a process for the electrochemical reduction of $CO_2$ catalysed by an electrochemically active biofilm, in the presence of a metal cathode and *Geobacter sulfurreducens*.

The existing art have several limitations as they use external electrical energy source for bioelectrochemical reduction of $CO_2$ to organic molecules through a device called potentiostat for regulations of desired potential. Further in the existing art the solubility of $CO_2$ in aqueous media is low. Moreover the in the existing art the product formation is known to be inhibitory to the biofilms thereby substantially effecting the overall reaction. In addition the processes existing in the art are run is batch mode only which is another major limitation.

Hence, there is need to develop a process/method which is devoid of existing drawbacks in the art and is also effective process to produce organic compounds useful as fuels and chemicals from $CO_2$.

SUMMARY OF THE INVENTION

The present invention provides a device for bioassisted conversion of carbon dioxide ($CO_2$) to organic compounds, said device consisting of:

(a) a means of introducing gas stream containing $CO_2$ [1] directly or through a microbubble generator [1A] in cathode chamber [2];

(b) a cathode electrode [3];

(c) a cathode aqueous medium [14] comprising chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone in the range of 0.2-2 ppm for the formation of electroactive microbes biofilm;

(d) a biofilm of electroactive microbes [4] consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022;

(e) an anode chamber [5] comprising an anode electrode [6] and an anode medium [7];

(f) a light source [8];

(g) an electrically conductive wire [9];

(h) optionally with:

(i) an ion-exchange membrane [10];

(ii) a $CO_2$ solubility improving column [11], wherein the $CO_2$ solubility improving column [11] consists of element [13], wherein the element [13] either consists of a biofilm of microbe selected from *Pseudomonas fragi* MTCC 25025 or a pure carbonic anhydrase immobilized on some suitable matrix that enhances the solubility of $CO_2$;

(iii) an in-situ product recovery column [12]; and (iv) a connector element [12A], which is means of recirculating aqueous medium or effluent or electrolyte medium from the in-situ product recovery column [12] to the $CO_2$ solubility improving column [11] and back to the cathode chamber [2].

Another aspect of the present invention provides a method for the bioassisted conversion of $CO_2$ to organic compounds employing the device as herein described, said method comprising the steps of:

(a) irradiating anode electrode [6] with a light source at a wavelength in a range of 380-780 nm;

(b) transferring electrons generated at an anode electrode [6] to a cathode chamber [5] via an electrically conductive wire [9];

(c) sparging a gas stream [1] directly or through a microbubble generator [1A] to the $CO_2$ solubility improving column [11] to enhance the solubility of $CO_2$, wherein the $CO_2$ solubility improving column [11] consists of element [13], wherein the element [13] either consists of a biofilm of microbe selected from *Pseudomonas fragi* MTCC 25025 or a pure carbonic anhydrase immobilized on some suitable matrix that enhances the solubility of $CO_2$;

(d) passing the highly solubilized stream of $CO_2$ of step (c) to the cathode chamber [2] near the cathode electrode [3] enveloped by biofilm of electroactive microbes [4], wherein biofilm of electroactive microbes consist of microbial consortia selected from *Enterobacter aerogenes* MTCC 25016, *Serratia* sp. MTCC 25017, *Shewanella* sp. MTCC 25020 and *Alicaligens* sp. MTCC 25022;

(e) obtaining an organic compound;

(f) passing the organic compound of step (e) optionally to an in situ product recovery column [12] to separate organic compound and aqueous medium or effluent; and (g) recirculating the aqueous medium/effluent without organic compound of step (f) to $CO_2$ improving column [11] through connector element [12A].

Yet another aspect of the present invention provides a biofilm of electroactive microbes consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022.

Yet another aspect of the present invention provides a method of developing biofilm of electroactive microbes on a cathode electrode, said method comprising the steps of:

(a) inoculating consortia consisting of two or more microbes selected from *Enterobacter aerogenes* MTCC 25016, *Serratia* sp. MTCC 25017, *Shewanella* sp. MTCC 25020 or *Alicaligens* sp. MTCC 25022 in a cathode chamber [2] consisting of cathode electrode [3] immersed in aqueous medium consisting of nitrogen, phosphorus and micronutrients along with chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone in the range of 0.2-2 ppm;

(b) allowing the microbial consortia of step (a) to grow for a period of 10 days in the growth medium;

(c) replacing the growth medium of step (b) with fresh growth medium and growing the microbial consortia for another 10 days;

(d) obtaining microbial biofilm on a cathode electrode; and (e) washing the cathode electrode of step (d) enveloped with microbial biofilm with aseptic saline.

DESCRIPTION OF THE INVENTION

Figure 1:
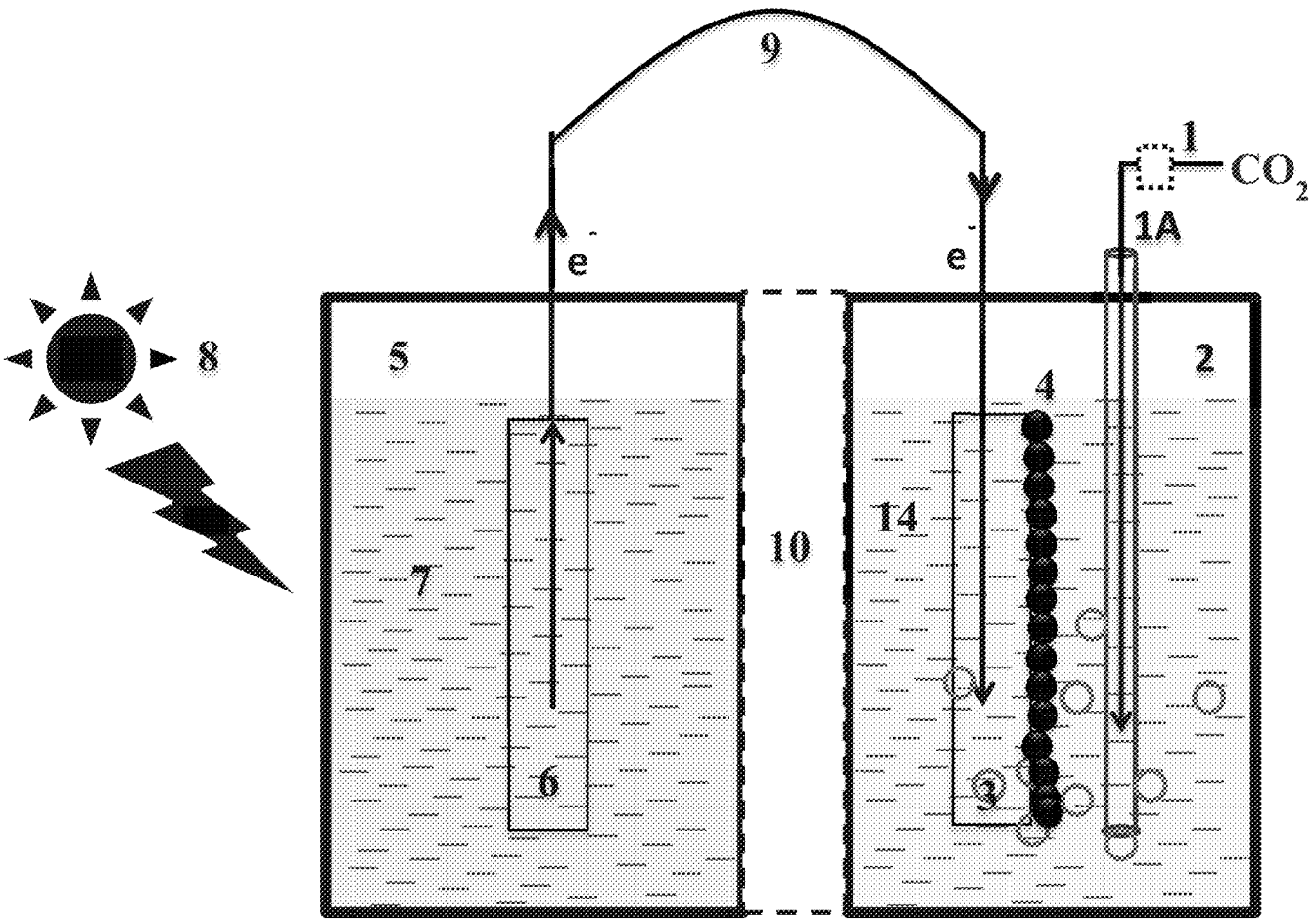
FIG. 1. Device operating with ion-exchange membrane without $CO_2$ improving column and in-situ product recovery column.

While the invention is susceptible to various modifications and/or alternative processes and/or compositions, specific embodiment thereof has been shown by way of example in the drawings and will be described in detail below. It should be understood, however that it is not intended to limit the invention to the particular processes and/or compositions disclosed, but on the contrary, the invention is to cover all modifications, equivalents, and alternative falling within the spirit and the scope of the invention as defined by the appended claims.

The procedures have been represented where appropriate by conventional representations, showing only those specific details that are pertinent to understanding the embodiments of the present invention so as not to obscure the disclosure with details that will be readily apparent to those of ordinary skill in the art having benefit of the description herein.

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Definitions

The term "Organic Compounds of at least Single Carbon Atom" as used in the context of the present invention means is many gaseous or liquid organic molecule having at least one carbon atom in their structure like methane, formic acid, methanol, ethanol and/or butanol.

The term "Electroactive microbes" or "Consortia of microbes" or "Microbial Consortia" or "Consortia of Electroactive Microbes" as used in the context of the present invention means mixture of the microbes having the ability to transfer electrons from the microbial cell to an electrode or vice versa. The terms "Electroactive microbes" or "Consortia of microbes" or "Microbial Consortia" or "Consortia of Electroactive Microbes" have been used interchangeably and are meant to have the same definition and meaning in context of the present invention.

The term "Biofilm of electroactive microbes" or "Microbial Biofilm or Biofilm/s" as used in the context of the present invention means a biofilm consisting of two or more microbes selected from *Enterobacter aerogenes* MTCC 25016, *Serratia* sp. MTCC 25017, *Shewanella* sp. MTCC 25020 or *Alicaligens* sp. MTCC 25022. The terms "Biofilm of electroactive microbes or Microbial Biofilm" have been used interchangeably and are meant to have the same definition and meaning.

The term "Bioelectrochemical System" as used in the context of the present invention means engineered systems in which the electronic transfer chain associated with microbial respiration is short-circuited. Electrons that would naturally flow from the substrate toward oxygen or another electron acceptor are collected at an electrode, on which the micro-organisms form a biofilm.

The terms "Element/s or Components or Means or Functional elements or Functional components" as used in the context of the present invention means the operating part/s or unit/s of a device as herein described, wherein each part or unit has some functional attribute as has been described in the instant invention and works alone or conjunction or in combination with the other part to achieve the desired effect i.e. efficient and enhanced conversion of $CO_2$ to organic compound. The terms "Element/s or Components or Means or Functional elements or Functional components" as used in the context of the present invention have been used interchangeably and are meant to have the same definition and meaning in the present invention.

The terms, for example, "a means of introducing gas stream containing $CO_2$" and "a connector element [12A], which is means of recirculating aqueous medium or effluent or electrolyte medium" are tubing or piping structures for guiding or conveying of fluid in a device of the present invention employed for the bioassisted conversion of carbon dioxide ($CO_2$) to organic compounds. These tubing or piping structure utilized in the present invention may be composed of any material commonly employed for the purpose by a skilled artisan, such as plastic and/or metal.

The present invention provides a device for conversion of carbon dioxide ($CO_2$) to organic compounds. The present invention also provides a devise for conversion of carbon dioxide ($CO_2$) to organic compounds of at least single carbon atom. The device as herein described for conversion of carbon dioxide ($CO_2$) to organic compounds comprises of various operating functional elements or components which enables to achieve efficient and high conversion of carbon dioxide ($CO_2$) to organic compounds.

In one aspect the present invention provides a device having unique arrangement of operating functional elements or components as depicted in FIGS. 1-4. In yet another aspect the present invention provides a device, wherein the unique arrangement of operating functional elements or components of the device as shown in FIGS. 1-4 enables the device to perform two different process modes or process schemes, namely First Scheme (or First Mode; depicted FIGS. 1 and 3) and Second Scheme (or Second Mode; depicted in FIGS. 2 and 4) to achieve high and efficient conversion of carbon dioxide ($CO_2$) to organic compounds. In other words the present invention provides a device which is capable of carrying out two process schemes or modes for efficient conversion of carbon dioxide ($CO_2$) to organic compounds. Thus the device as herein described in the present invention is capable of operating two process schemes or modes for efficient conversion of carbon dioxide ($CO_2$) to organic compounds.

Figure 3:
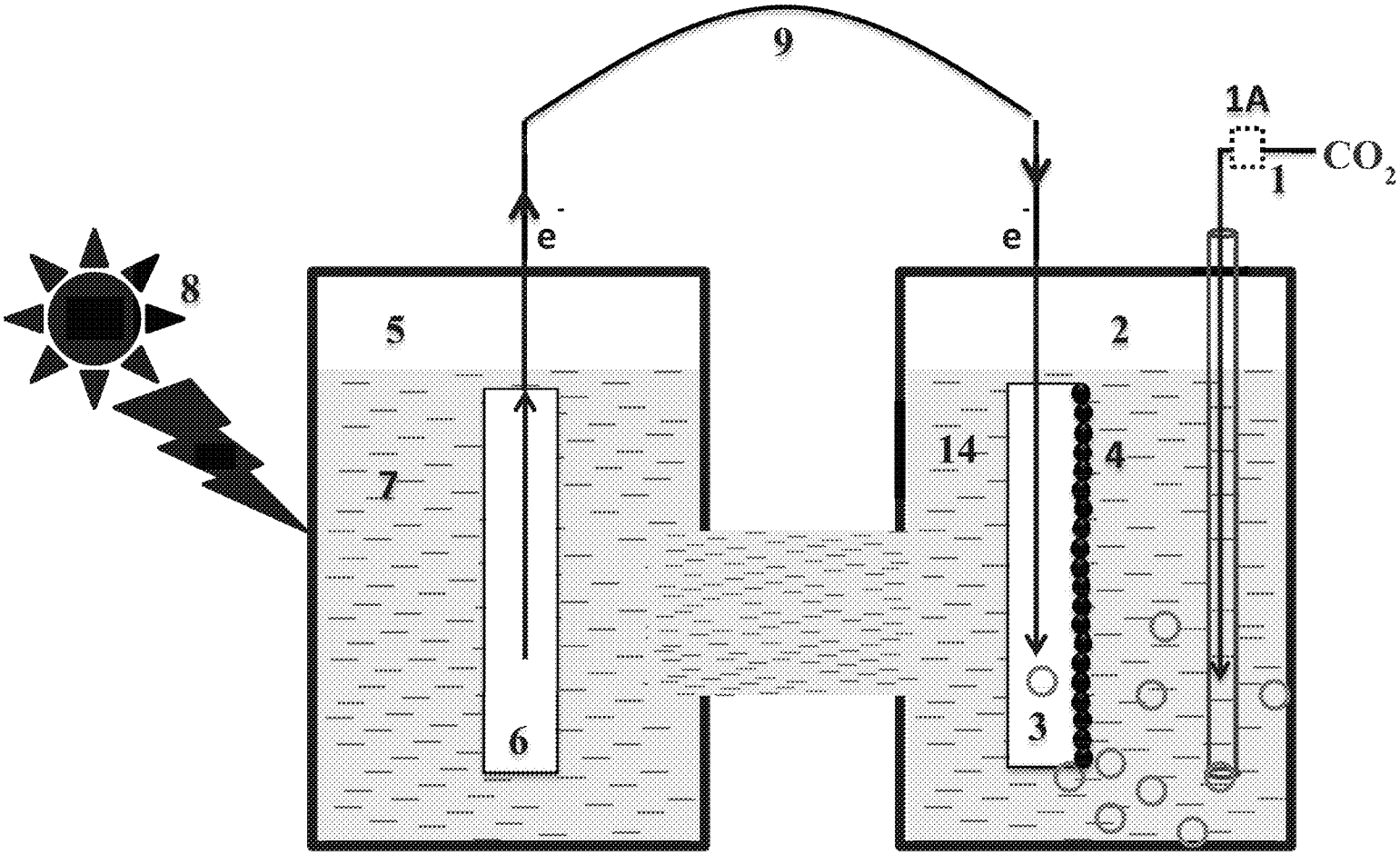
FIG. 3. Device operating without ion-exchange membrane, $CO_2$ improving column and in-situ product recovery column FIG. 4. Device operating without ion-exchange membrane but with $CO_2$ improving column and in-situ product recovery column

In one aspect the present invention provides a first scheme or first mode as depicted in FIG. 1 and FIG. 3, wherein the gas stream containing carbon dioxide [1] is delivered directly or through a source which generates microbubble or microbubble generator [1A] to a cathode chamber [2]. The cathode electrode [3] used in the present invention is made of inexpensive and low cost material selected from graphite, graphite felt, porous graphite, graphite powder carbon paper, carbon cloth, carbon felt, carbon wool, carbon foam, stainless steel as such or modified or combinations thereof. In another aspect the cathode electrode of the present invention is immersed in an aqueous medium [14] comprising of nitrogen compounds, phosphorus compounds and micronutrients having a pH in the range of 5-12.

As herein described the term aqueous medium or cathode electrolyte medium or cathode aqueous medium [14] refers to the medium present in the cathode chamber into which cathode electrode is immersed. The terms aqueous medium or cathode electrolyte medium or cathode aqueous medium [14] has been interchangeably used in the present invention and have the same meaning.

Another aspect of the present invention provides an anode chamber [5] which consists of least one anode electrode [6] and electrolyte [7]. In another aspect of the present invention the anode electrode [6] is a photoeletrode or photoanode. In yet another aspect of the present invention the electrolyte medium [7] in the anode chamber [5] may be water or aqueous medium containing inorganic salts.

One more aspect of the present invention provides a cathode electrode [3] and anode electrode [6], which may be immersed in same or different electrolyte medium. The photo-electrode in the anode chamber is illuminated with a light source like sunlight, xenon lamp, etc. [8]. On photo-illumination the photo-electrode produces electrons. These electrons move to cathode and facilitate the metabolic activity of biofilm of electro-active microbe(s) to reduce the $CO_2$ to organic molecules.

In another aspect the present invention provides a cathode chamber [2] which contains at least one conductive electrode i.e., cathode electrode [3] wherein the cathode electrode is enveloped by a biofilm of electroactive microbe(s) [4]. In another aspect of the present invention one or multiple cathodes electrode/s may be enveloped by biofilm comprising of physiologically different or same electroactive microbe(s). Another aspect of the present invention provides cathode electrode which is enclosed in a cathode chamber [2] comprising of aqueous medium [14] containing nitrogen, phosphorus compounds and micronutrients that has pH of in range of 5 to 12, wherein the aqueous medium also consist of chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone in the range of 0.2-2 ppm which enable or aid in formation of biofilm of electroactive microbes.

In another aspect the present invention provides anode photoelectrode made of materials as selected from 3% Mo—$BiVO_4/RhO_2$, 6% Mo+2% W—$BiVO_4$/Pt, 2% Mo—$BiVO_4$/Co, $PO_4$-doped $BiVO_4$, W-doped $BiVO_4$/Co, $BiVO_4$/FeOOH, $BiVO_4$FeOOH/NiOOH, Mo—$BiVO_4$/p-NiO, Si—$Fe_2O_3/IrO_2$, Si—$Fe_2O_3$, 5% Ti—$Fe_2O_3$, 19.7% Ti—$Fe_2O_3$, 1% Ti—$Fe_2O_3$/Co, $Fe_2O_3$, Co—$Fe_2O_3/MgFe_2O_4$, Ti+Ge/$Ta_3N_5/Co(OH)_x$, $Ta_3N_5/Co(OH)_x$, $Ta_3N_5/IrO_2$, Ba—$Ta_3N_5$/Co, $Ta_3N_5/Co(OH)_x$, $Ta_3N_5/Co_3O_4$, Ge doped GaN nanowire, InGaN, NiO/GaN, n-type semiconductors, p-type semiconductors or any such material known in prior art for this purpose.

Both cathode [2] and anode [5] chambers as herein described contains medium having nitrogen, phosphorus and micronutrient source. Both the cathode and anode chambers [2, 5] may contain single or multiple electrodes {i.e. the cathode electrode [3] and anode electrode [6]} which may be made up of same material or of different material. Both electrodes are contacted by electro-conductive wire [9]. The electrons extracted from water at anode [6] are delivered to cathode [3].

One more aspect of the present invention in general provides that the medium of anode and cathode chamber has salinity in the range of 0.01% to 10% and pH in the range of 5 to 8. The medium present in the anode chamber [5] and cathode chamber [2] may have same or different salinity and. Yet another aspect of the present invention provides that the anode photoelectrode [6] present in the anode chamber [5] is illuminated with some light source [8] like sunlight or xenon lamp etc. On photo-illumination the anode photoelectrode [6] produces electrons. These electrons move from anode to cathode through electro-conductive live wire [9] and facilitate the metabolic activity of biofilm of electro-active microbe(s) to reduce the $CO_2$ to organic molecules.

Another aspect of the present invention provides a solid electrolyte membrane (ion-exchange membrane) [10] which prevent the movement of electrolyte medium from anode chamber to cathode chamber and vice-versa.

One aspect of the present invention provides a device wherein the solid electrolyte membrane (ion-exchange membrane) [9] is optional, i.e. the device may consist or may not consist of a solid electrolyte membrane (ion-exchange membrane) [9] as depicted in the FIGS. 1 and 3. Another aspect of the present invention provides a device operated by means of Scheme 1, wherein the said device may have solid electrolyte membrane (ion-exchange membrane) [9] as depicted in FIG. 1 or may not have solid electrolyte membrane (ion-exchange membrane) [9] as depicted in FIG. 3.

Figure 2:
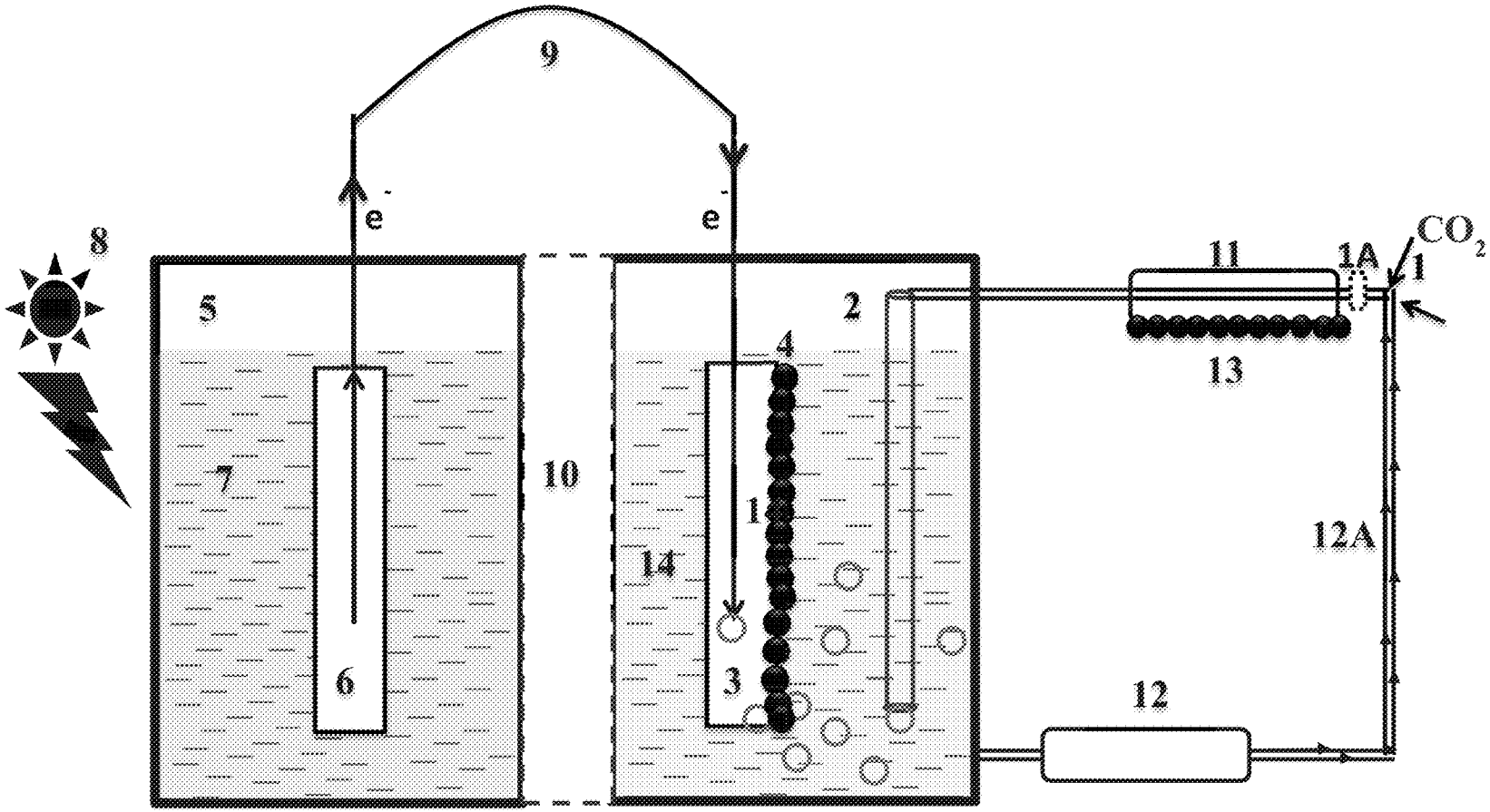
FIG. 2. Device operating with ion-exchange membrane, $CO_2$ improving column and in-situ product recovery column.
Figure 4:
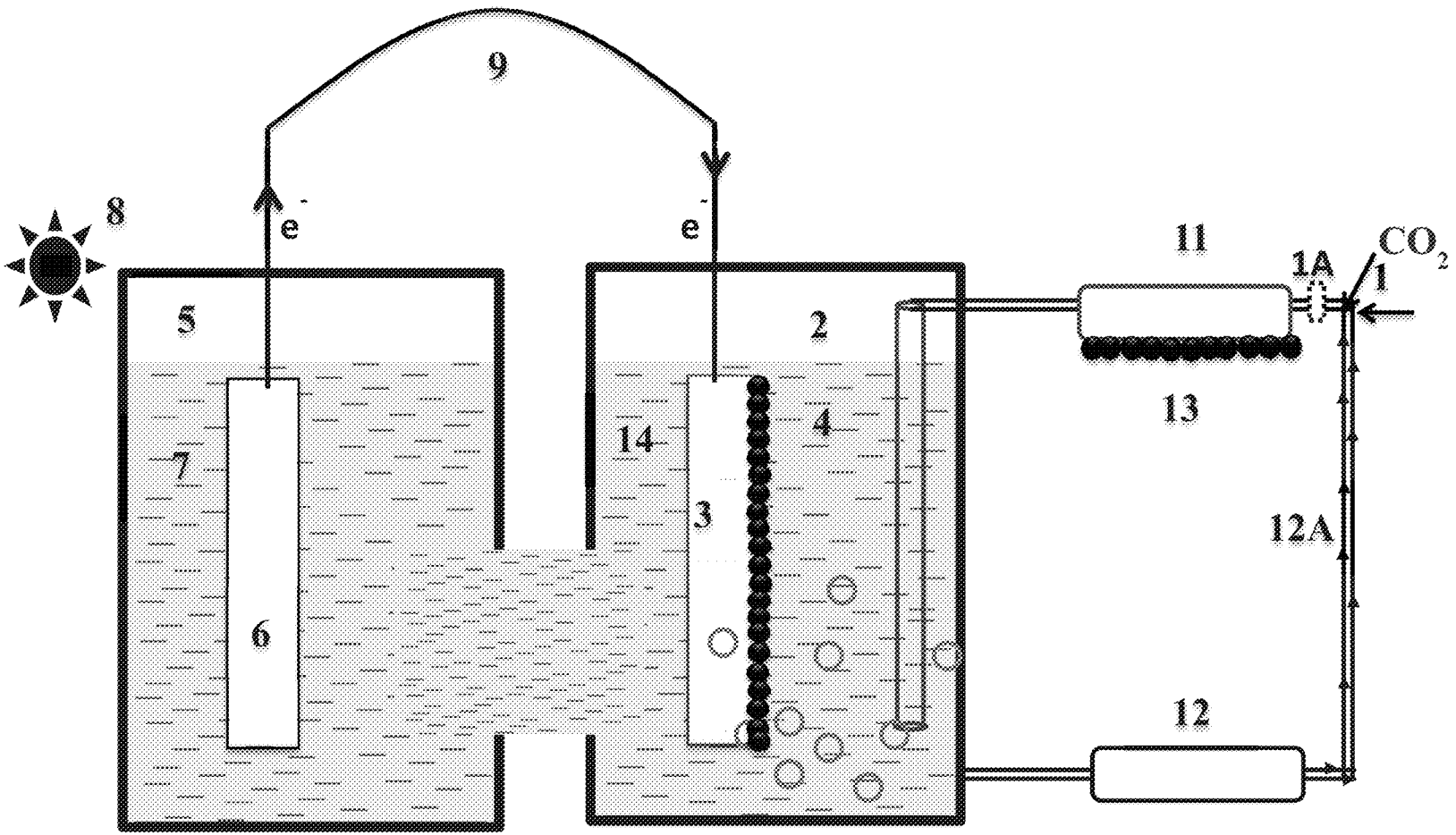

Further in another aspect the present invention also provides a device performing a process of Second Scheme (or Second Mode) as depicted in FIG. 2 and FIG. 4. The present invention in one aspect provides a device (performing a process in second scheme) which in addition to functional operating elements or components or means [1, 1A] to [9] also comprises a $CO_2$ solubility improving column element [11], an in-situ product recovery column element [12], connector element [12A] and an element [13], wherein the element [13] which consist of a biofilm of microbe capable of producing carbonic anhydrase on an inert material or a pure carbonic anhydrase immobilized on some suitable matrix.

Yet in another aspect the present invention provides a device in which (during the process of second scheme) the electrolyte medium comprising organic compound from cathode chamber [2] is passed to in-situ product recovery column [12] for in situ recovery of the product i.e. organic compound formed by biotransformation. After in situ product recovery the effluent without organic compound from in situ product recovery membrane [12] is circulated back to the cathode chamber [2] via connector element [12A] and $CO_2$ solubility improving column [11]. The $CO_2$ solubility improving column [11] may either consist of a biofilm of microbe capable of producing carbonic anhydrase on an inert material or consist of a pure carbonic anhydrase immobilized on some suitable matrix [13]. The suitable matrix herein consist of carbon nanotubes, metal organic framework, zeolites, Zinc-ferrite, nickel ferrite, Zinc-nickel (Zn—Ni) ferrite etc. to increase the enzyme stability and longevity. The presence of element [13] which consists of biofilm of microbe capable of producing carbonic anhydrase on an inert material or pure carbonic anhydrase immobilized on some suitable matrix further improves the $CO_2$ solubility in the medium and makes it available to the microbes present at cathode (FIGS. 2 and 4).

Another aspect of the present invention provides an aqueous medium or cathode electrolyte medium or cathode aqueous medium which is coming out of the in-situ product recovery column [12] and is being recirculated or recycled through connector element [12A] to the cathode chamber [2] via $CO_2$ solubility improving column [11] is called as effluent. In other words the effluent is aqueous medium or cathode electrolyte medium or cathode aqueous medium without organic compound which is passed out of in-situ product recovery column [12] (after recovering product or organic compound) and recirculated to the cathode chamber [2] via connector element [12A] and $CO_2$ solubility improving column [11]. The product or organic compound is recovered in the in-situ product recovery column [12].

Thus in yet another aspect the present invention provides a device operating by second Scheme or performing a process of second scheme as depicted in FIGS. 2 and 4, wherein the device depicted in FIG. 2 consist of the solid electrolyte membrane (ion-exchange membrane) [10] whereas device depicted in FIG. 4 does not consist of solid electrolyte membrane (ion-exchange membrane) [10].

In yet another aspect the present invention provides a device operating under second Scheme or performing a process of second scheme (FIGS. 2 and 4) with significant advantage for improving solubility or concentration of the $CO_2$ in the medium thereby ensuring enhanced production of organic compounds. Thus in order to further improve or enhance the solubility or concentration of the $CO_2$, the present invention in one aspect provides in the process of alternate second scheme provides a $CO_2$ solubility improving column [11] which receives the medium consisting of highly concentration of $CO_2$, wherein the $CO_2$ solubility improving column [11] solubilizes the additional $CO_2$ in the medium and thereafter this medium which contains additional or extra solubilized $CO_2$ is transferred to the cathode chamber [2]. In other words the second scheme which is an another alternate process scheme as herein described consists of gas stream or medium containing carbon dioxide which is delivered in the inlet of $CO_2$ solubility improving column [11] either directly or through a microbubble generator [1A].

The advantages of device as herein described as depicted in FIGS. 2 and 4 is that the aqueous medium or electrolyte medium or effluent can continuously be recirculated in the cathode chamber [2] via means of in-situ product recovery column [12] and connector element [12A] through of $CO_2$ solubility improving column [11]. In this respect the organic compounds along with aqueous medium or electrolyte medium or effluent are passed to the in-situ product recovery column [12] where the organic compounds are recovered and further the aqueous medium or electrolyte medium or effluent without organic compound is recirculated through connector element [12A] to the $CO_2$ solubility improving column [11] from where it is circulated back to cathode chamber [2]. This ensures continuously dosing of effluent to the cathode chamber [2] in an appropriate rate thereby making the process a continuous process. Accordingly the device as depicted in FIGS. 2 and 4 enable continuous and appropriate flow of medium in the cathode chamber [2].

The present invention in one aspect also provides multiple sources of carbon dioxide selected from carbon dioxide in an effluent from a combustion process of coal, petroleum processing, biomass gasification, an industrial process that releases carbon dioxide, industrial flue gas, carbon dioxide from geothermal sources etc. In general, any convenient source of $CO_2$ can be used. One aspect of the present invention provides compounds that are produced from $CO_2$ using present process include methanol, ethanol, acetic acid, butanol, proponal, propionic acid, formic acid, butanedioic acid in mixture or individually or any other organic acid, alcohol, aldehyde, ketones with at least one carbon.

The Carbon dioxide ($CO_2$), as a gaseous molecule, should be solubilized in liquid for better contact of biocatalyst with it. Otherwise, most of the gas will escape into head space and lower product formation will occur. Therefore another aspect of the present the present invention provides $CO_2$ solubility improving column [11] before the reactor.

The $CO_2$ solubilization can be carried out by various methods as disclosed below in addition to use of biofilms as disclosed in the present invention.

- Carbonic anhydrase enzyme from any biological source like plant, bacteria, bovine red blood cell etc., can be used in the $CO_2$ solubility improving column [10] to increase the $CO_2$ solubility.
- This enzyme can be used in free form such or immobilized on different matrices like carbon nanotubes, metal organic framework, zeolites, Zinc-ferrite, nickel ferrite, Zinc-nickel (Zn—Ni) ferrite etc. to increase the enzyme stability and longevity.
- Specific microbes immobilized on specific matrix polyurethane, glass beads or any other suitable matrixes as herein described in the present invention can produce carbonic anhydrase exocellularly can be used in this column to form the biofilm and can be used for $CO_2$ solubilization.

The carbon dioxide is delivered to the $CO_2$ solubility improving column [11] in the form of macrobubbles (1-2 mm in size), in the form of microbubbles and nanobubbles (25 micron or less in size). The delivery of $CO_2$ in form of microbubble and nanobubble improves $CO_2$ dissolution as well as its availability to microbial cells and also improves nutrient solubility. The microbubble and nanobubble can be generated using the microbubble generator or other such system known for this purpose in prior art and macrobubbles can be used by using sponge diffuser.

The present invention in one of its aspect also provides in situ product recovery membrane [12] that consist of material selected from ion exchange resins, activated carbon, macroporous polystyrene anion-exchange, hollow fiber membrane, zeolites or activated charcoal. Further the in situ recovery of organic material may also consist of pervaporation process as known in prior art In another aspect the present invention also provides that the pH of anode [6] and cathode [3] has a significant role in formation of biofilm of electroactive microbes well as $CO_2$ biotransformation. In general the difference between pH of anode [6] and cathode [3] creates a potential difference between them which helps in electron transfer. Maintaining the similar pH throughout the operation will help in stabilizing the biocatalyst activities and $CO_2$ transformation. Change in pH may result in impact over $CO_2$ solubility and availability to the biofilm, microbial dynamics of the biofilm, metabolic activities of the bacterial species present in biofilm, etc. However, maintaining the reactor at same pH will reduce the robustness and diversity of the microbial population of the biofilm. If the pH is allowed to change according to the $CO_2$ solubility, it will trigger the $CO_2$ consuming metabolic pathways of microbes, which enhances the ability of biocatalyst towards $CO_2$ transformation. This also allows the biofilm to be robust and to show their activity in a wide range of pH, which allows to implement the process using flue gas also. Moreover, wide pH range also helps for a membraneless system that is more viable in practical, in terms of accommodating both anodic and cathodic reactions.

Yet another aspect of the present invention provides a method of developing biofilm of electroactive microbes [4]. As per the said aspect the biofilm of electroactive microbes is developed on the conductive cathode electrode [3] which reduces $CO_2$ as herein described in the present invention.

The biofilms of the present invention play major role in transformation of $CO_2$ into value-added chemicals or organic chemicals, as they are the reaction catalyzing entities. The formation of the biofilm on the electrode can be improved by any of the following ways:

- Application of genome shuffling for the transfer of genes responsible for the secretion of EPS into the non secreting microbes will also increase the biofilm formation
- Electrodes with bumpy, uneven, rough surface with many patches raised above the rest will increase the biofilm formation rather than the flat/plain surfaces.
- Use of nano materials such as nano rods, nano powder, nano plates, nano sheets, to increase the surface area for biofilm attachment
- Use of activated charcoal on the electrode will increase the biofilm formation on electrode
- Use of porous electrodes such as carbon felt, graphite felt, carbon cloth will increase the biofilm forming ability Use of conductive porous materials such as alginate as support material around the electrode will also increase the biofilm formation Using biofilm inducing molecules like 4-hydroxyphenethyl alcohol, Furanosyl borate ester, oxylipins, N-butyryl-DL-homocysteine thiolactone, 2-Heptyl-3-hydroxy-4(1H)-quinolone, N-Hexanoyl-DL-homoserine lactone N—[(RS)-3-Hydroxybutyryl]-L-homoserine lactone in the medium at the dosing rate of 0.2-2 ppm. The present invention in one aspect use the biofilm inducing molecules as described above.

Further the present invention also provides for a method for long term storage of these biofilms of electroactive microbes. In its various aspects the present invention provides that the biofilm of electroactive microbes may be stored through one or more methods as described below considering the storage of said biofilm is very difficult as there is a chance of change over in microbial dynamics during storage.

(a) Biofilms can be stored under continuous operation of bioreactor with biofilm under similar condition, where it is formed in the reactor.

(b) Biofilm can also be stored with the same electrolyte and substrate in air tight bag at 4-5° C. The electrolyte and substrate should be changed at regular time intervals.

(c) Biofilms can also be stored in at 4° C. after encapsulating in membrane like egg membrane, onion cell membrane in a bag containing electrolyte and substrate for longer time.

(d) Lyophilize the biofilm grown electrode and can be stored for future use at −80° C.

(e) Selective membrane that allows the flow of only liquid can be made as a bag around the biofilm covered electrode and hence it will protect the biofilm from leaching out or disturbing. This can be stored in similar electrolyte it has grown and can be used after long term storage.

In an aspect the present invention provides a method as herein described wherein the said method can be carried out in the single membrane. In another aspect the method as herein described for present invention can be run in batch, semi-continuous and continuous mode.

In another aspect the present invention provides a device which operates under first and second Schemes as depicted in FIGS. 1-4 as herein described may consist of electroactive microbes that may be grown in around both anode [6] and cathode [3] electrodes in the anode [2] and cathode [5] chambers of the reactor respectively. In view of the said aspect of the present invention the electroactive microbes at anode electrode [6] can be used for oxidation of some substrate like glucose, hydrocarbons etc. while electroactive microbes at cathode electrode [3] can be used for reduction of $CO_2$.

In another aspect the cathode chamber may contain any metal, inorganic salt or organic molecule which will serve as electron donor.

The present invention in one aspect provides use of a device, a bioassisted process bioelectrochemical or electro-biochemical system and biofilm of the electroactive microbes for transformation of $CO_2$ into organic acid, alcohol, aldehyde, ketones with at least one carbon.

The present invention in another aspect provides "Electroactive microbes or consortia of microbes or microbial consortia or Consortia of electroactive microbes" which are can be used in a device, a bioassisted process or bioelectrochemical or electro-biochemical system for transformation of $CO_2$ into organic acid, alcohol, aldehyde, ketones with at least one carbon. The present invention also provides "Electroactive microbes or consortia of microbes or microbial consortia or Consortia of electroactive microbes" as herein described wherein the said electroactive microbes are active or function at a temperature in the range of 10° C. to 52° C.

Another aspect of the present invention provides bio-electrochemical or electro-biochemical system comprising of a device functioning through Schemes 1 and 2 which is depicted in FIGS. 1-4 as herein described, which uses $CO_2$ for obtaining organic compounds. Further the present invention also provides for a bio-electrochemical or electro-biochemical system as herein described wherein carbon dioxide source is selected from group comprising waste-water effluents, effluents from combustion process of coal, petroleum, methane, natural gas, biomass, organic carbon, an industrial process that releases carbon dioxide, carbon dioxide from geothermal sources and/or atmospheric carbon dioxide.

In yet another aspect the present invention provides a method for bioassisted conversion of carbon dioxide ($CO_2$) to organic compounds comprising of Schemes 1 and 2 as depicted in FIGS. 1-4 as herein described.

The present invention in another aspect provides the significance of the Ion-exchange membrane [10] that helps in restricting the oxygen flow from anode [6] to cathode [3] during electrolysis of water. The $CO_2$ reduction at cathode [3] is normally possible under anaerobic environment. If oxygen reaches cathode [3], the microbial dynamics of electroactive microbes will change from anaerobic to aerobic and the $CO_2$ reduction is not possible as the electrons will be consumed by $O_2$. Thus in the present invention there is a need to regulate total cell potential at a value below the electrolysis at anode. If the total cell potential is below the value of electrolysis then there is no requirement of membrane. In this case, instead of $CO_2$ reduction using protons generated from water electrolysis, hydration of $CO_2$ will takes place followed by its microbial transformation. The electroactive microbes of the present invention have the ability to transform $CO_2$ at lower applied potentials. Henceforth, the ion-exchange membrane [9] may be an optional requirement in these systems/process/device of the present invention.

In the aspect of the present invention generally, the anode chamber [5] consist of salts to enhance the electrolysis and thus, proton flow to cathode for $CO_2$ reduction. If ion-exchange membrane [10] is absent, then salts need not be added, as the electrolyte medium becomes saline and effects microbial growth. Low salt concentrations near anode [5] reduce the electrolysis and needs more applied potential to anode [5] to maintain the required potential gradient. But in the present invention, the anode helps in $CO_2$ hydration but not electrolysis and hence there is no need of adding excess salts that may cause inhibition to microbial growth. So, the system without membrane will not make any difference in its performance.

One of the issues in the system present invention is the drop in pH at the anode in the absence of ion-exchange membrane [10] in the reactor where anode is designed to carry out water electrolysis. Due to the anodic oxidation, protons will be released and the pH of anode gets dropped, which also affects whole reactor including the cathode. The acidic pH at cathode results in low $CO_2$ solubility and least availability to the microbes on cathode for its reduction. The microbial dynamics also will change according to the dropped pH. The basic pH of the reactor will help in more $CO_2$ hydration and its further conversion to value-added products.

Overall, bioelectrochemical system with selectively enriched, high-efficient microbial blend under low applied potentials will not require an ion permeable membrane.

In the present invention the $CO_2$ initially get solubilized into bicarbonate by the action of enzymes or electroactive microbes and this bicarbonate will further converted into valuable products by microbial metabolic pathways. The major $CO_2$ reducing microbial pathways include Calvin-Benson-Bassham-cycle (photosynthesis), Reductive TCA (Arnon-Buchanan) cycle, Reductive Acetyl-CoA (Wood-Ljungdahl) cycle and Acyl-CoA carboxylate pathway, where the acetate is the primary product and can be further reduced to higher carbon molecules. For the $CO_2$ transformation, it is necessary to combine $CO_2$ with another reactant having higher Gibbs free energy, as the chemical reactions are driven by differences between free energy changes of the reactants and products. Hydrogen ($H_2$) is the known energy carrier that plays critical role in the $CO_2$ reduction, especially in the biological systems. However, the external supply of $H_2$ will make the process energy intensive again. In the proposed process, the $H_2$ will be produced in situ by the microbial reduction or the protons will be directly utilized to reduce $CO_2$ during microbial enzymatic pathways. The electron uptake by the microbes from electrode may follow the direct route through membrane bound cell organelles, conductive pili or through soluble mediators like $H_2$, redox shuttlers like primary/secondary metabolites and metal ions. The energy required for $CO_2$ to cross the thermodynamic energy barrier for the transformation will be lowered by the microbial intervention in this process and hence a low external voltage supply is sufficient. $CO_2$ can be solubilized in a column just before the reactor, which helps in high availability of $CO_2$ to the biocatalyst in the reactor. Addition of mediators such as neutral red, methylene blue, AQDS, etc., in the reactor will enhance the electron uptake by the biocatalyst and reduce the electron losses.

Accordingly, the main embodiment of the present invention provides a device for bioassisted conversion of carbon dioxide ($CO_2$) to organic compounds, said device consisting of:

(a) a means of introducing a gas stream containing $CO_2$ [1] directly or through a microbubble generator [1A] in a cathode chamber [2];
(b) a cathode electrode [3];
(c) a cathode aqueous medium [14] comprising chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone in the range of 0.2-2 ppm for the formation of electroactive microbes biofilm;
(d) a biofilm of electroactive microbes [4] consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022;
(e) a anode chamber [5] comprising an anode electrode [6] and an anode medium [7];
(f) a light source [8];
(g) an electrically conductive wire [9];
(h) optionally with:
  (i) an ion-exchange membrane [10];
  (ii) a $CO_2$ solubility improving column [11], wherein the $CO_2$ solubility improving column [11] consists of element [13], wherein the element [13] either consists of a biofilm of microbe selected from *Pseudomonas fragi* MTCC 25025 or a pure carbonic anhydrase immobilized on some suitable matrix that enhances the solubility of $CO_2$;
  (iii) an in-situ product recovery column [12]; and
  (iv) a connector element [12A], which is means of recirculating effluent passed from in-situ product recovery column [12] to the $CO_2$ solubility improving column [11] and back to the cathode chamber [2].

Another embodiment of the present invention provides a device as herein described, wherein cathode electrode [3] is made of material selected from graphite, graphite felt, porous graphite, graphite powder carbon paper, carbon cloth, carbon felt, carbon wool, carbon foam, stainless steel as such or modified or combinations thereof.

Another embodiment of the present invention provides a device as herein described, wherein cathode electrode [3] is immersed in an aqueous medium [14] consisting of nitrogen compounds, phosphorus compounds and micronutrients having pH in the range of 5-12.

Another embodiment of the present invention provides a device as herein described, wherein the microbes of microbial consortia are capable of producing carbonic anhydrase.

Another embodiment of the present invention provides a device as herein described wherein the light source [7] is sunlight, xenon lamp, etc.

Another embodiment of the present invention provides a device as herein described, wherein in-situ product recovery column [10] is made of material selected from ion exchange resins, activated carbon, macroporous polystyrene anion-exchange, hollow fiber membrane, zeolites or activated charcoal.

Another embodiment of the present invention provides a device as herein described, wherein the cathode [2] and anode chamber [5] consist of single or multiple cathode and anode electrodes.

Another embodiment of the present invention provides a device as herein described wherein the anode chamber [5] and cathode chamber [2] are optionally separated by an ion-exchange membrane [10].

Another embodiment of the present invention provides a device as herein described, wherein the organic compounds obtained includes methanol, ethanol, acetic acid, butanol, proponal, propionic acid, formic acid, butanedioic acid in mixture or individually or any other organic acid, alcohol, aldehyde, ketones with at least one carbon.

Another embodiment of the present invention provides a method for bioassisted conversion of $CO_2$ to organic compounds employing the device as herein described, said method comprising the steps of:

(a) irradiating anode electrode [6] with light source at a wavelength in a range of 380-780 nm;
(b) transferring electrons generated at an anode electrode [6] to a cathode chamber [5] via an electrically conductive wire [9];
(c) sparging gas stream [1] directly or through a microbubble generator [1A] to the $CO_2$ solubility improving column [11] to enhance the solubility of $CO_2$, wherein the $CO_2$ solubility improving column [11] consists of element [13], wherein the element [13] either consists of a biofilm of microbe selected from *Pseudomonas fragi* MTCC 25025 or a pure carbonic anhydrase immobilized on some suitable matrix;
(d) passing the highly solubilized stream of $CO_2$ of step (c) to the cathode chamber [2] near the cathode electrode [3] enveloped by biofilm of electroactive microbes [4], wherein biofilm of electroactive microbes consists of microbial consortia selected from *Entero-*

*bacter aerogenes* MTCC 25016, *Serratia* sp. MTCC 25017, *Shewanella* sp. MTCC 25020 and *Alicaligens* sp. MTCC 25022;

(e) obtaining an organic compound;

(f) passing the organic compound of step (e) optionally to an in situ product recovery column [12] to separate organic compound and aqueous medium or effluent; and (g) recirculating the aqueous medium/effluent without organic compound of step (f) to the $CO_2$ solubility improving column [11] through connector element [12A].

Another embodiment of the present invention provides a method for bioassisted conversion of $CO_2$ to organic compounds employing the device as herein described, wherein the anode chamber [5] and cathode chamber [2] are optionally separated by an ion-exchange membrane [10] to restrict flow of oxygen to cathode chamber [2] from anode chamber [5].

Another embodiment of the present invention provides a method for bioassisted conversion of $CO_2$ to organic compounds employing the device as herein described wherein the electroactive microbes of biofilm function at a temperature in the range of 10° C. to 52° C.

Another embodiment of the present invention provides a method for bioassisted conversion of $CO_2$ to organic compounds employing the device as herein described wherein step (c) the gas stream consists of $N_2$ and $CO_2$ in the ratio of 50:50.

Another embodiment of the present invention provides a method for bioassisted conversion of $CO_2$ to organic compounds employing the device as herein described, wherein the cathode [2] and anode chamber [5] may consist of single or multiple cathode and anode electrodes.

Another embodiment of the present invention provides a method for bioassisted conversion of $CO_2$ to organic compounds employing the device as herein described, wherein the organic compounds includes methanol, ethanol, acetic acid, butanol, proponal, propionic acid, formic acid, butanedioic acid in mixture or individually or any other organic acid, alcohol, aldehyde, ketones with at least one carbon.

Another embodiment of the present invention provides a biofilm of electroactive microbes consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022.

Another embodiment of the present invention provides a biofilm of electroactive microbes wherein the biofilm of electroactive microbes can be stored in electrolyte solution in air tight conditions at a temperature of 4-5° C.

Another embodiment of the present invention provides a biofilm of electroactive microbes wherein the biofilm of electroactive microbes can be stored at a temperature of 4-5° C. by encapsulating with egg membrane or onion cell membrane.

Another embodiment of the present invention provides a biofilm of electroactive microbes wherein biofilm of electroactive microbes along with cathode electrode can be lyophilized at a temperature of −80° C.

Another embodiment of the present invention provides a biofilm of electroactive microbes wherein the electroactive microbes of biofilm are active at a temperature in the range of 10° C. to 52° C.

Another embodiment of the present invention provides a method of developing biofilm of electroactive microbes on a cathode electrode, said method comprising the steps of:

(a) inoculating consortia consisting of two or more microbes selected from *Enterobacter aerogenes* MTCC 25016, *Serratia* sp. MTCC 25017, *Shewanella* sp. MTCC 25020 or *Alicaligens* sp. MTCC 25022 in a cathode chamber [2] consisting of cathode electrode [3] immersed in aqueous medium consisting of nitrogen, phosphorus and micronutrients along with chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone in the range of 0.2-2 ppm;

(b) allowing the microbial consortia of step (a) to grow for a period of 10 days in the growth medium;

(c) replacing the growth medium of step (b) with fresh growth medium and growing the microbial consortia for another 10 days;

(d) obtaining microbial biofilm on a cathode electrode; and (e) washing the cathode electrode of step (d) enveloped with microbial biofilm with aseptic saline.

Another embodiment of the present invention provides a method of developing biofilm of electroactive microbes on a cathode electrode, wherein the cathode chamber is sparged continuously with a gas mixture of $N_2$ and $CO_2$ in the ratio of 50:50.

Another embodiment of the present invention provides a method of developing biofilm of electroactive microbes on a cathode electrode, wherein the chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone enable the formation of biofilm of electroactive microbes.

Another embodiment of the present invention provides use of a device as herein described for the for bioassisted conversion of carbon dioxide ($CO_2$) to organic compounds.

Another embodiment of the present invention provides use of biofilm of electroactive microbes consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022 in a device as herein described for the for bioassisted conversion of carbon dioxide ($CO_2$) to organic compounds.

Another embodiment of the present invention provides use of biofilm of electroactive microbes consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022 for the for bioassisted conversion of carbon dioxide ($CO_2$) to organic compounds.

Yet another embodiment of the present invention provides a device for bioassisted conversion of carbon dioxide ($CO_2$) to organic compounds as depicted in FIGS. 1-4, wherein device comprises of common and optional main operating components as described below:

The common operating components consist of:

(a) a means of introducing a gas stream containing $CO_2$ [1] directly or through a microbubble generator [1A] in cathode chamber [2];

(b) a cathode electrode [3];

(c) a cathode aqueous medium [14] comprising chemicals selected from 4-hydroxyphenethyl alcohol, Furanosyl borate ester, oxylipins, N-butyryl-DL-homocysteine thiolactone, 2-Heptyl-3-hydroxy-4(1H)-quinolone and N-Hexanoyl-DL-homoserine lactone N—[(RS)-3-Hydroxybutyryl]-L-homoserine lactone in the range of 0.2-2 ppm for the formation of electroactive microbes biofilm;

(d) a biofilm of electroactive microbes [4] consisting of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022;

(e) an anode chamber [5] comprising an anode electrode [6] and an anode medium [7];

(f) a light source [8];

(g) an electrically conductive wire [9];

And the optionally components consist of:

(i) an ion-exchange membrane [10];

(ii) a $CO_2$ solubility improving column [11], wherein $CO_2$ solubility improving column [11] consists of element [13], wherein the element [13] either consists of a biofilm of microbe selected from *Pseudomonas fragi* MTCC 25025 or a pure carbonic anhydrase immobilized on some suitable matrix that enhances the solubility of $CO_2$;

(iii) an in-situ product recovery column [12]; and (iv) a connector element [12A], means of recirculating aqueous medium or effluent or electrolyte medium from the in-situ product recovery column [12] to the $CO_2$ solubility improving column [11] and back to the cathode chamber [2].

EXAMPLES

Example 1: Formation of Biofilm of Electroactive Microbes

The electroactive microbes of the present invention consist of consortia of microbes selected from *Enterobacter aerogenes* MTCC 25016, *Serratia* sp. MTCC 25017, *Shewanella* sp. MTCC 25020, *Alicaligens* sp. MTCC 25022. The consortia of electroactive microbes have ability to reduce $CO_2$.

To develop a biofilm of electroactive microbes the cathode chamber is inoculated by consortia of microbes selected from *Enterobacter aerogenes* MTCC 25016, *Serratia* sp. MTCC 25017, *Shewanella* sp. MTCC 25020, *Alicaligens* sp. MTCC 25022 in equal ratio (1:1) and was sparged continuously with gas mixture containing $N_2$:$CO_2$ in the ratio of 50:50. The cathode chamber [2] is also supplemented with additives 4-hydroxyphenethyl alcohol and Furanosyl borate ester at 2 ppm concentration which facilitates the biofilm formation. After 10 days the liquid medium from cathode chamber [2] is replaced by fresh medium aseptically. This step is repeated for 2 times at an interval of 10 days. Thus medium is replaced at interval of 10 days for the 4 cycles or unless until stable current consumption was observed. This results in the stable biofilm over conductive electrode which can effectively reduce $CO_2$ using electrons. Subsequently, the cathode is taken out and washed with normal saline aseptically. This cathode containing biofilm of selective bacteria can be used in $CO_2$ reduction system disclosed in this invention. This is also useful in microbial fuel cell or other bioelectrochemical system.

The medium for preparing biofilm of electroactive microbes consist of (g/l) of 0.55 $Na_2CO_3$, 5.0 $NaHCO_3$, 2.0 $KH_2PO_4$ 2.0 $K_2HPO_4$, 0.1 $MgSO_4$, 0.5 $(NH_4)_2SO_4$, 2.0 $ZnSO_4$, 2.0 Yeast extract, 0.5 NaCl and 1 ml. Trace element. The trace element solution (gram per liter) comprises Nitrilotriacetic acid (0.1), $FeSO_4.7H_2O$ (0.2), $MnCl_2.4H_2O$ (0.005), $CoCl_2.6H_2O$ (0.02), $CaCl_2.2H_2O$ (0.08), $CuCl_2.H_2O$ (0.03), $H_3BO_3$ (0.02), $Na_2MoO_4$ (0.02), $Na_2SeO_3$ (0.06), $NiSO_4$ (0.03), $SnCl_2$ (0.03).

Example 2: Evaluation of Consortia to Reduce Carbon Dioxide and Identification of Product The biofilm of the selective microbes *Enterobacter aerogenes* MTCC 25016, *Serratia* sp. MTCC 25017, *Shewanella* sp. MTCC 25020, *Alicaligens* sp. MTCC 25022 grown on working electrode i.e., carbon cloth was transferred to cathode chamber of a 250 ml H type two chambered cells of glass. The cathode contained media contained (g/l) of 0.5 $Na_2CO_3$, 2.0 $NaHCO_3$, 2.0 $KH_2PO_4$ 2.0 $K_2HPO_4$, 0.1 $MgSO_4$, 0.5 $(NH_4)_2SO_4$, 0.5 $KNO_3$, 2.0 $ZnSO_4$, 0.5 NaCl and 2 ml. Trace element. The trace element solution (gram per liter) comprises Nitrilotriacetic acid (0.1), $FeSO_4.7H_2O$ (0.2), $MnCl_2.4H_2O$ (0.005), $CoCl_2.6H_2O$ (0.02), $CaCl_2.2H_2O$ (0.08), $CuCl_2.H_2O$ (0.03), $H_3BO_3$ (0.02), $Na_2MoO_4$ (0.02), $Na_2SeO_3$ (0.06), $NiSO_4$ (0.03), $SnCl_2$ (0.03). The pH of cathode was 7.

In the anode chamber, includes a counter electrode made up of carbon steel and which includes a region form of a $PO_4$-doped $BiVO_4$ as semiconductor on its surface. Photoanodes of $PO_4$-doped $BiVO_4$ were produced by using electrophoretic deposition (EPD) technique. Thus, 48 mg of $PO_4$-doped $BiVO_4$ and 12 mg of iodine were added to 30 ml of acetone, sonicated for 5 minutes, and stirred for 30 minutes to form a stable suspension. EPD was performed onto 1×1 cm2 area of clean FTO glass substrate at 55 V for 5 minutes with another clean FTO glass as the counter electrode. The $BiVO_4$-deposited FTO glass was washed with absolute alcohol, sintered in a furnace at 400° C. for 30 minutes in the air, and cooled to room temperature. And then copper wires were attached with silver paste to make the electrical connections. Finally, the uncoated FTO surface was covered with epoxy resin.

The cathode contained 1% NaOH as the electrolyte having pH 11. Both electrodes are contacted by electro-conductive wire made up of nickel.

The cathode and anode chamber was separated by electrolyte membrane made up on Nafion.

The anode was irradiated with the light from light source having wavelength in the range of 380 to 780 nm. Electrons extracted from water at anode due to were delivered to cathode.

$CO_2$ was continuously sparged at 20 ml/min rate as only carbon source very near to cathode having biofilm. The concentration of $CO_2$ was not limited. This assembly was kept under stirring at temperature 35° C. and atmospheric pressure. Once, the current consumption become stable, samples was withdrawn and analyzed by gas chromatography for presence of the fuels and hydrocarbons.

When biofilm of all microbes in one cathode, the major product which formed under the experimental conditions are butanol and C-4 fatty acid (butanoic acid). The cumulative concentration of the major product formed in 240 hrs by the mixture of bacteria was 16.6 g/l and 41 g/l for butanol and C-4 fatty acid (butanoic acid), respectively. No organic products were produced in the absence of microorganisms. These results showed that consortia could accept electrons from electrodes with the reduction of $CO_2$ and that most of the electrons transferred from electrodes to cells were converted towards extracellular product rather than biomass production.

Example-3

The biofilm of the selective microbes *Enterobacter aerogenes* MTCC 25016, *Serratia* sp. MTCC 25017, *Shewanella* sp. MTCC 25020, *Alicaligens* sp. MTCC 25022 grown on working electrode i.e., graphite felt was transferred to cathode chamber of a 250 ml H type two chambered cells of glass. The cathode contained media contained (g/l) of 0.5 $Na_2CO_3$, 2.0 $NaHCO_3$, 2.0 $KH_2PO_4$ 2.0 $K_2HPO_4$, 0.1 $MgSO_4$, 0.5 $(NH_4)_2SO_4$, 0.5 $KNO_3$, 2.0 $ZnSO_4$, 0.5 NaCl and 2 ml. Trace element. The trace element solution (gram per liter) comprises Nitrilotriacetic acid (0.1), $FeSO_4.7H_2O$ (0.2), $MnCl_2.4H_2O$ (−0.005), $CoCl_2.6H_2O$ (0.02), $CaCl_2.2H_2O$ (0.08), $CuCl_2.H_2O$ (0.03), $H_3BO_3$ (0.02), $Na_2MoO_4$ (0.02), $Na_2SeO_3$ (0.06), $NiSO_4$ (0.03), $SnCl_2$ (0.03). The pH of cathode was 7. The electrolyte was passed through the in site product separation membrane which concentrates methanol and it was passed through the a $CO_2$ solubilizing column along with $CO_2$ which was continuously sparged at 20 ml/min rate. The $CO_2$ solubilizing column contains *Pseudomonas fragi* IOC-S2 (MTCC 25025) immobilized on the polyurethane. This bacterium has ability to produce extracellular carbonic anhydrase and form biofilm over the solid matrix. The $CO_2$ enriched electrolyte was put in the cathode chamber. In this way the cathode was made in continuous mode.

In the anode chamber, includes a counter electrode made up of carbon steel and which includes a region form of PO4-doped $BiVO_4$ as semiconductor on its surface.

The anode contained 1% KOH as the electrolyte having pH>11. Both electrodes are contacted by electro-conductive wire made up of platinum. The cathode and anode chamber was separated by electrolyte membrane made up on Nafion. The anode was irradiated with the light from light source having wavelength in the range of 380 to 780 nm. Electrons extracted from water at anode due to were delivered to cathode.

This assembly was kept under stirring at temperature 35° C. and atmospheric pressure. Once, the current consumption become stable, samples was withdrawn and analyzed by gas chromatography for presence of the fuels and hydrocarbons.

When biofilm of all microbes in one cathode, the major product which formed under the experimental conditions are butanol. The electrolyte at cathode was passed through the in situ product recovery column. In this column. butanol was continuously recovered from electrolyte by employing silicone rubber-coated silicalite membrane based pervaporation method. The cumulative concentration of the major product formed in 120 hrs by the mixture of bacteria was 21.5 g/l. The effluent of the in situ product recovery column was send to $CO_2$ solubility column to make the process continuous. The No organic products were produced in the absence of microorganisms. These results showed that consortia could accept electrons from electrodes with the reduction of $CO_2$ and that most of the electrons transferred from electrodes to cells were converted towards extracellular product rather than biomass production.

Example-4

The biofilm of the selective microbes *Enterobacter aerogenes* MTCC 25016, *Serratia* sp. MTCC 25017, *Shewanella* sp. MTCC 25020, *Alicaligens* sp. MTCC 25022, grown on working electrode i.e., graphite felt was transferred to a 250 ml cells of glass. The electrolyte contained media contained (g/l) of 0.5 $Na_2CO_3$, 2.0 $NaHCO_3$, 2.0 $KH_2PO_4$ 2.0 $K_2HPO_4$, 0.1 $MgSO_4$, 0.5 $(NH_4)_2SO_4$, 0.5 $KNO_3$, 2.0 $ZnSO_4$, 0.5 NaCl and 2 ml. Trace element. The trace element solution (gram per liter) comprises Nitrilotriacetic acid (0.1), $FeSO_4.7H_2O$ (0.2), $MnCl_2.4H_2O$ (−0.005), $CoCl_2.6H_2O$ (0.02), $CaCl_2.2H_2O$ (0.08), $CuCl_2.H_2O$ (0.03), $H_3BO_3$ (0.02), $Na_2MoO_4$ (0.02), $Na_2SeO_3$ (0.06), $NiSO_4$ (0.03), $SnCl_2$ (0.03). The electrolyte was passed through the in site product separation column consisting of sulphonic ion-exchange resin which concentrates methanol and it was passed through the a $CO_2$ solubilizing column after adjusting its pH 8 along with $CO_2$ which was continuously sparged at 20 ml/min rate. The $CO_2$ solubilizing column contains carbonic anhydrase enzyme immobilized on zinc metal organic framework. This improves the hydration of the $CO_2$. The $CO_2$ enriched electrolyte was put in the cathode chamber. In this way the cathode was made in continuous mode. The cell includes a counter electrode made up of carbon steel and which includes a region form of a semiconductor on its surface. Both electrodes are contacted by electro-conductive wire made up of platinum. The anode was irradiated with the light from light source having wavelength in the range of 380 to 780 nm. Electrons extracted from water at anode due to were delivered to cathode at potential difference of −0.200 V.

This assembly was kept under stirring at temperature 35° C. and atmospheric pressure. Once, the current consumption become stable, samples was withdrawn and analyzed by gas chromatography for presence of the fuels and hydrocarbons.

When biofilm of all microbes in one cathode, the major product which formed under the experimental conditions are methanol. The cumulative concentration of the methanol formed in 120 hrs was 57 g/l. No organic products were produced in the absence of microorganisms. These results showed that consortia could accept electrons from electrodes with the reduction of $CO_2$ and that most of the electrons transferred from electrodes to cells were converted towards extracellular product rather than biomass production.

The invention claimed is:

1. A device for bioassisted conversion of carbon dioxide ($CO_2$) to organic compounds selected from the group consisting of methanol, butanol and butanoic acid, said device consisting of:

(a) a means of introducing gas stream containing $CO_2$ [1] directly or through a microbubble generator [1A] in cathode chamber [2];

(b) a cathode electrode [3];

(c) cathode aqueous medium [14] comprising chemicals selected from 4-hydroxyphenethyl alcohol; furanosyl borate ester; oxylipins; N-butyryl-DL-homocysteine thiolactone; 2-heptyl-3-hydroxy-4(1H)-quinolone; N-hexanoyl-DL-homoserine lactone; and N—[(RS)-3-hydroxybutyryl]-L-homoserine lactone in the range of 0.2-2 ppm for the formation of electroactive microbes biofilm;

(d) biofilm of electroactive microbes [4] consist of consortia of electroactive microbes selected from *Enterobacter aerogenes* MTCC 25016, *Serratia* sp. MTCC 25017, *Shewanella* sp. MTCC 25020 and *Alicaligens* sp. MTCC 25022;

(e) an anode chamber [5] comprising an anode electrode [6] and anode medium [7];

(f) a light source [8];

(g) an electrically conductive wire [9];

(h) optionally with:

(i) an ion-exchange membrane [10];

(ii) a $CO_2$ improving column [11], wherein $CO_2$ solubility improving column [11] consist of element [13], wherein the element [13] either consist of a biofilm of microbe selected from *Pseudomonas fragi* MTCC 25025 or a pure carbonic anhydrase immobilized on a matrix that enhances the solubility of $CO_2$; wherein the matrix is selected from the group consisting of carbon nanotubes, metal organic framework, zeolites, zinc-ferrite, nickel ferrite and zincnickel (ZnNi) ferrite;

(iii) in-situ product recovery column [12]; and (iv) a connector element [12A], which is means of recirculating aqueous medium or effluent or electrolyte medium from in-situ product recovery column [12] to $CO_2$ improving column [11] and back to cathode chamber [2].

2. The device as claimed in claim 1, wherein cathode electrode [3] is made of material selected from graphite, graphite felt, porous graphite, graphite powder carbon paper, carbon cloth, carbon felt, carbon wool, carbon foam, stainless steel as such or modified or combinations thereof.

3. The device as claimed in claim 1, wherein cathode electrode [3] is immersed in an aqueous medium [14] consisting of nitrogen compounds, phosphorus compounds and micronutrients having pH in the range of 5-12.

4. The device as claimed in claim 1, wherein the microbes of microbial consortia are capable of producing carbonic anhydrase.

5. The device as claimed in claim 1, wherein the light source [7] is sunlight, xenon lamp, etc.

6. The device as claimed in claim 1, wherein in-situ product recovery column [12] is made of material selected from ion exchange resins, activated carbon, macroporous polystyrene anion-exchange, hollow fiber membrane, zeolites or activated charcoal.

7. The device as claimed in claim 1, wherein the cathode [2] and anode chamber [5] consist of single or multiple cathode and anode electrodes.

8. The device as claimed in claim 1, wherein the anode chamber [5] and cathode chamber [2] are optionally separated by an ion-exchange membrane [10].

9. A method for bioassisted conversion of $CO_2$ to organic compounds selected from the group consisting of methanol, butanol and butanoic acid employing the device as claimed in claim 1, said method comprising the steps of:

(a) irradiating the anode electrode [6] with the light source at a wavelength in range of 380-780 nm;

(b) transferring electrons generated at the anode electrode [6] to the cathode chamber [2] via the electrically conductive wire [9];

(c) sparging gas stream [1] directly or through the microbubble generator [1A] to the $CO_2$ improving column [11] to enhance the solubility of $CO_2$;

(d) passing the highly solubilized stream of $CO_2$ of step (c) to the cathode chamber [2] near the cathode electrode [3] enveloped by the biofilm of electroactive microbes [4];

(e) obtaining an organic compound;

(f) passing the organic compound of step (e) optionally to the in situ product recovery column [12] to separate the organic compound and aqueous medium or effluent; and (g) recirculating the aqueous medium/effluent without the organic compound of step (f) to the $CO_2$ improving column [11] through a connector element [12A].

10. The method as claimed in claim 9, wherein the anode chamber [5] and the cathode chamber [2] are optionally separated by an ion-exchange membrane [10] to restrict flow of oxygen to the cathode chamber [2] from the anode chamber [5].

11. The method as claimed in claim 9, wherein the electroactive microbes of the biofilm function at a temperature in the range of 10° C. to 52° C.

12. The method as claimed in claim 9, wherein in step (c) the gas stream consists of $N_2$ and $CO_2$ in the ratio of 50:50.

13. The method as claimed in claim 9, wherein the cathode chamber [2] and the anode chamber [5] may consist of single or multiple respective cathode and anode electrodes.

14. The biofilm of electroactive microbes as claimed in claim 9, wherein the biofilm of electroactive microbes are stored in electrolyte solution in air tight conditions at a temperature of 4-5° C.

15. The biofilm of electroactive microbes as claimed in claim 9, wherein the biofilm of electroactive microbes are stored at a temperature of 4-5° C. by encapsulating with an egg membrane or an onion cell membrane.

16. The biofilm of electroactive microbes as claimed in claim 9, wherein biofilm of electroactive microbes along with the cathode electrode are lyophilized at a temperature of −80° C.

* * * * *